United States Patent [19]

Kahan

[11] Patent Number: 4,586,353

[45] Date of Patent: May 6, 1986

[54] TRIPLE NEEDLE HEIGHT SELECTION MEANS FOR KNITTING MACHINES

[76] Inventor: Jeno Kahan, 444 Neptune Ave., Brooklyn, N.Y. 11224

[21] Appl. No.: 722,512

[22] Filed: Apr. 12, 1985

Related U.S. Application Data

[63] Continuation of Ser. No. 465,153, Feb. 9, 1983, abandoned.

[51] Int. Cl.[4] ..... D04B 9/38; D04B 15/68

[52] U.S. Cl. ..... 66/230; 66/233

[58] Field of Search ..... 66/215, 230, 233

[56] References Cited

U.S. PATENT DOCUMENTS 1,670,791 5/1928 Wildt et al. ..... 66/230

3,425,242 2/1969 Wiesinger ..... 66/230

3,425,244 2/1969 Wiesinger et al. ..... 66/233

*Primary Examiner*—Wm. Carter Reynolds

*Attorney, Agent, or Firm*—Charles E. Temko

[57] ABSTRACT

A triple needle height selective means for knitting machines. For each needle, there is provided two columns of perforations in a pattern strip and two selector levers receiving the dictates from the columns of perforations. A racket is associated with an individual needle having two heads and a single effective tail, the heads being positioned at two distinctive heights. Depending upon which selector lever is activated, motion is transmitted through the racket to elevate the needle to a corresponding height.

6 Claims, 8 Drawing Figures

TRIPLE NEEDLE HEIGHT SELECTION MEANS FOR KNITTING MACHINES

RELATED APPLICATION

This application is a continuation of my copending application Ser. No. 465,153; filed Feb. 9, 1983 now abandoned.

BACKGROUND OF THE INVENTION

In circular knitting machines, especially those of the multifeed type, pattern means is frequently employed and one form thereof known as a jacquard mechanism employs several units spaced about the machine, each of which comprises a drum, a flexible pattern strip, and selectors with one selector at most for each needle or instrumentality. These pattern strips in endless or belt form have perforations punched therein in rows which align with slots in the drum and the pattern strip is advanced with the drum by sprocket teeth on the latter engaged in corresponding sprocket openings at the pattern strip edges. The selectors in the form of levers have spring pressed pins which either ride on the pattern strip surface or enter a perforation therein and thus read the pattern. As a result, they convey the pattern dictates to rackets by means of a selector cam which exerts a force on the activated levers which in turn rotate said rackets about their axes. The rackets, upon activation, raise the needles either directly or through jacks. To alleviate the force required by the selector cam to exert on the levers in raising the jacks and/or needles, it is of common practice to allow the rackets to raise the jacks and/or needles to a predetermined height, and then to provide a raising cam which will further raise the jacks and/or needles to their desired final heights. An example of one form of such a mechanism according to the prior art is evident in U.S. Pat. No. 2,786,343.

While the mechanisms previously used for needle height selection serve very well for the most part, they are strictly limited in being able to select between only two needle heights. According to this invention, means are provided to allow and specify three needle heights for each needle at every possible activation of the needle.

BRIEF SUMMARY OF THE INVENTION

The new selection mechanism provides triple needle height selection using the following modifications to the conventional mechanism. For each needle or instrumentality, there is associated with it two columns of perforations on the pattern strip and two selection levers receiving their dictates from said columns of perforations. A racket means having a single tail and two heads is associated with said needle, said two columns of perforations, and said two levers drive said single tail, which will engage the needle directly or through a jack. The tips of said two racket heads are be positioned at two distinct heights, the entire racket being controlled and activated directly by the two selection levers. If a cam section is used to further raise the jacks and/or needles, two channels will be provided in the cam section to accommodate the jacks and/or needles being raised to two distinct initial elevations by the twin headed bi-level racket means.

The procedure for specifying the three needle heights and the means in which the specifications are carried out are as follows. If in the appropriate two columns on the pattern strip there are no perforations, the two levers, the racket means, and the jack and/or needle are all stationary. In such case, the jack and/or needle are initiated in their knitting operation with the lowest height. If there is a perforation just in the column corresponding to the racket head with the lower tip, its corresponding lever will advance causing the selector cam to exert a force only on said racket head. Thus the racket means will rotate about its axis a predetermined angle causing the jack and/or needle to be raised to a predetermined height. If there is a perforation in the other column, which corresponds to the racket head with the higher tip, the racket means will rotate about its axis an even greater angle causing the jack and/or needle to be raised to an even greater height.

Although in some instances the racket means may raise the jacks and/or needles to their desired final heights, it is of common practice to have a cam section assist in the action. If a cam section is used to further raise the jacks and/or needles, two raising cams affixed to it will be provided, one cam being positioned higher than the other. The lower raising cam will raise the jacks and/or needles from the lower initial elevation, through a predetermined path, to a final elevation. The higher raising cam will raise the jacks and/or needles from the higher initial elevation, through a higher predetermined path, to a higher final elevation. Thus, by making a perforation in one of said two columns on the pattern strip, it is possible to elevate the jack and/or needle in its knitting operation to a second and third height.

The invention will be described in detail by reference to a preferred embodiment thereof as illustrated in the accompanying drawings and in the following description.

DETAILED DESCRIPTION OF A PREFERRED EMBODIMENT

Through the figures, like numerals are used for identification of like elements and parts.

Figure 1:
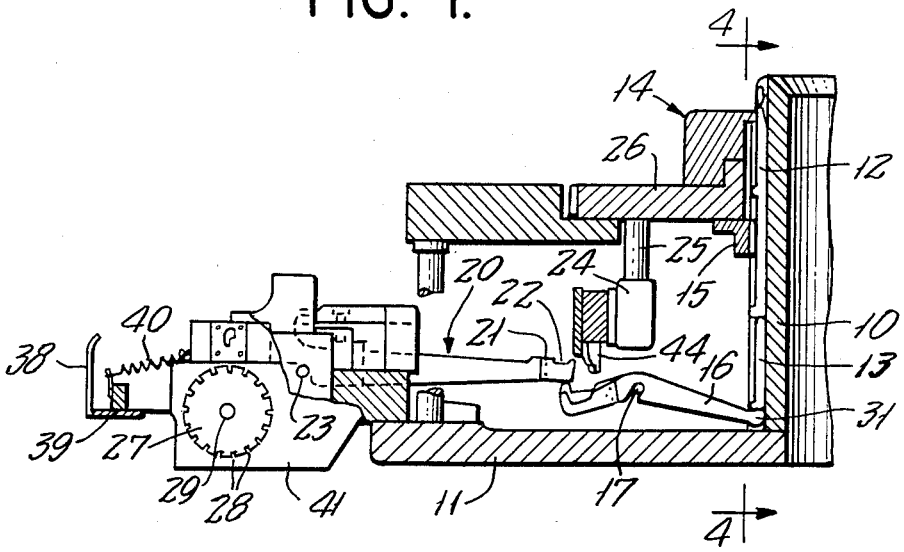
FIG. 1 is a section through part of a knitter and pattern unit to which the invention has been applied.
Figure 2:
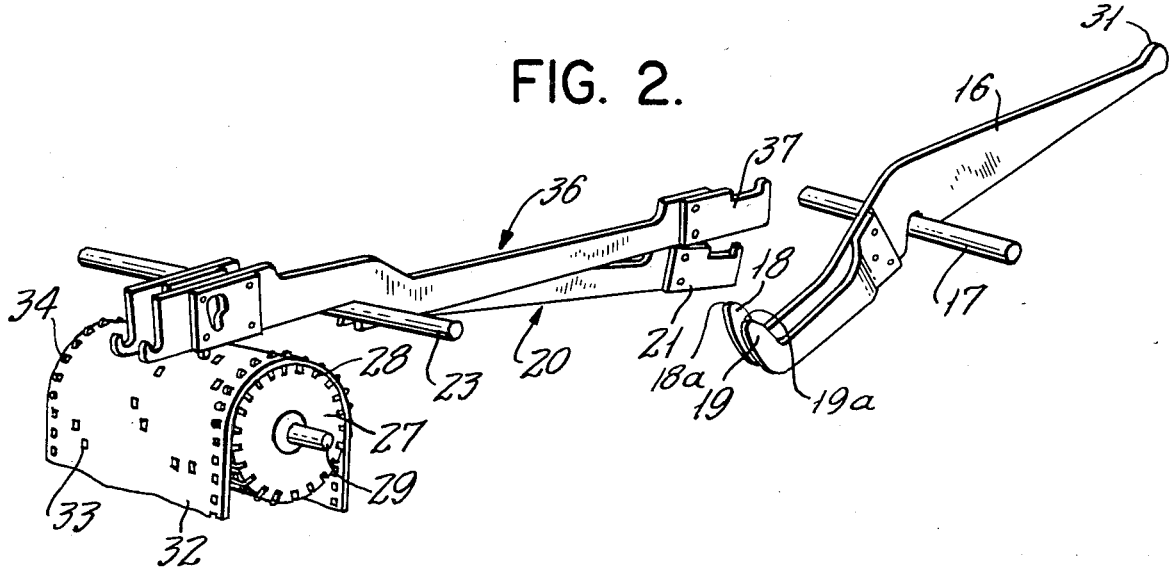
FIG. 2 is a perspective view of a drum, its corresponding pattern strip, and a pair of selection levers with their corresponding two headed bi-level racket means.

Now referring to FIGS. 1 and 2, the invention is shown as applied to a knitting machine having a cylinder 10, base 11, needles 12, jacks 13, and a rotary cam ring and cam assembly generally indicated at 14. These parts are well know and need no further description. A drum 27 having slots 28 is rotatable on shaft 29 held in bracket 41 bolted to base 11. Actually each bracket 41 carries two drums, one at each side and thuse two units comprising several selection levers at each drum. The number of levers depends upon the gauge of the machine and the number of units spaced about the same.

Drum 27 is advanced a slot or groove at a time by a Geneva or other movement. It carries a paper or other flexible pattern strip 32, endless in form, and having a pattern incorporated therein in the form of perforations 33 which are spaced to align with the slots 28 in the drum as the pattern is advanced by the drum, there being sprocket teeth 34 on the drum engaged with appropriate perforations at the pattern strip's edges. Selection levers 20 and 36 are guided and restrained by slotted guides or combs and are thus maintained aligned with their respective columns of perforations on the pattern strip and with their respective racket heads. Bracket 41 is extended outwardly and carries a shield 38 and hooked bar 39, to the latter of which are attached springs 40, one for each lever. As the drum is advanced one slot or groove, those levers, feeler ends 35 of which have entered the slot through a perforation will be pushed inwardly. Notch 22 of an activated lever will engage selector cam 44 carried on bracket 24 depending from a stud 25 fixed in cam plate 26 and thus rotatable therewith. As selector cam 44 engages notch 22, the activated lever rotates about shaft 23 wherein lever end 21 is forced downwardly causing racket means 16 to be rocked on its pivot 17 to lift its jack 13 and needle 12 at end 31. Rotating the lever 20 frees feeler end 35 from its slot and as soon as the lever is released by cam 44, spring 40 pulls said lever outwardly to read the pattern at the next succeeding slot. In some instances selector cam 44 may assist in the return movement.

Figure 3:
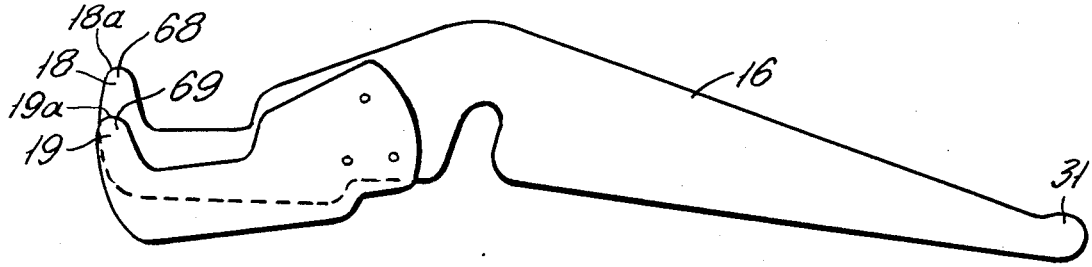
FIG. 3 is an enlarged view of a twin headed bilevel racket means.

According to a preferred embodiment of the invention, each racket means 16 can engage one of the two selection levers 20 and 36 by means of its two heads 18 and 19. The twin headed bi-level racket means, as illustrated in FIG. 3, can be perceived as a conventional racket having one tail 31 which engages and lifts jack 13, and two heads 18 and 19 having free end surfaces thereon 18*a* and 19*a*, respectively, the two heads being formed with the appropriate angular deviation between them. Thus, the tips 68 and 69 of the two heads 18 and 19 are positioned at different heights. Head 18, having the higher tip, is positioned ahead of the lower tipped head 19 with respect to the normal direction of machine operation. Referring to FIG. 2, selection and rotation of lever 20 results in a downward motion of end 21, which in turn engages head 18 of racket means 16. Selection of the complementary lever 36 results in a downward motion of its end 37, which engages head 19 of said racket means. Thus, by selecting one of the two levers 20 and 36 by means of a perforation in the appropriate column on pattern strip 32, racket means 16 can rotate about axis 17 one of two predetermined angles, which in turn raises, by means of end 31, jack 13 and needle 12 to one of two predetermined elevations. After the knitting operation, jack cam section 15 bolted to cam plate 26, as seen in FIG. 1, lowers jack 13 thus returning racket 16 to its original position. In summary, it is possible to begin the knitting operation with the jack and needle in one of three distrinct heights. The lowest initial height is achieved when neither lever 20 nor lever 36 is activated, the middle initial height is achieved when lever 36 is activated thus engaging head 19, and the highest initial height is achieved when lever 20 is activated thus engaging head 18. For each jack and needle there is asociated with them one twin headed bi-level racket means, two levers, and two columns of perforations on the pattern strip to control said levers.

Figure 4:
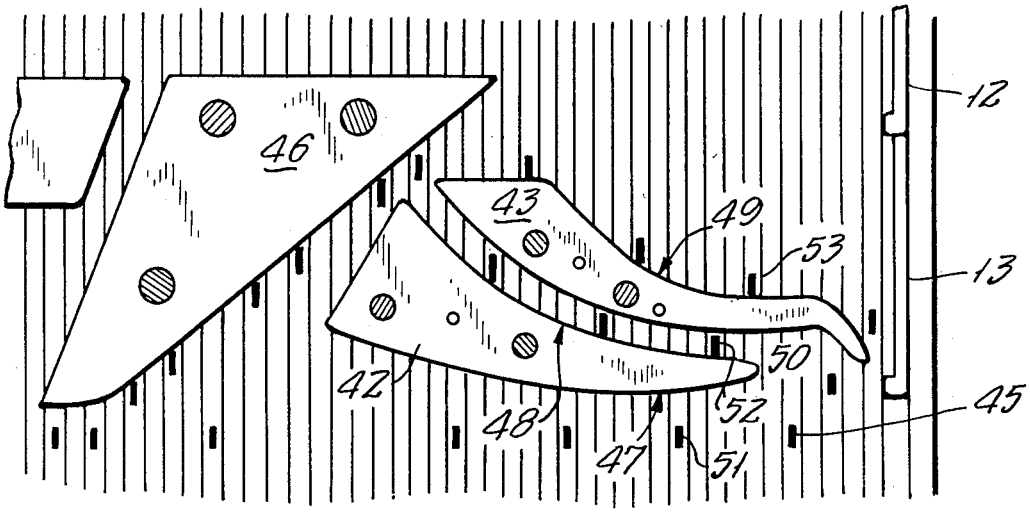
FIG. 4 is a sectional view of part of the knitter as seen from the exterior, illustrating the function of a modified jack cam section, said view taken generally on line 4—4 of FIG. 1.
Figure 5:
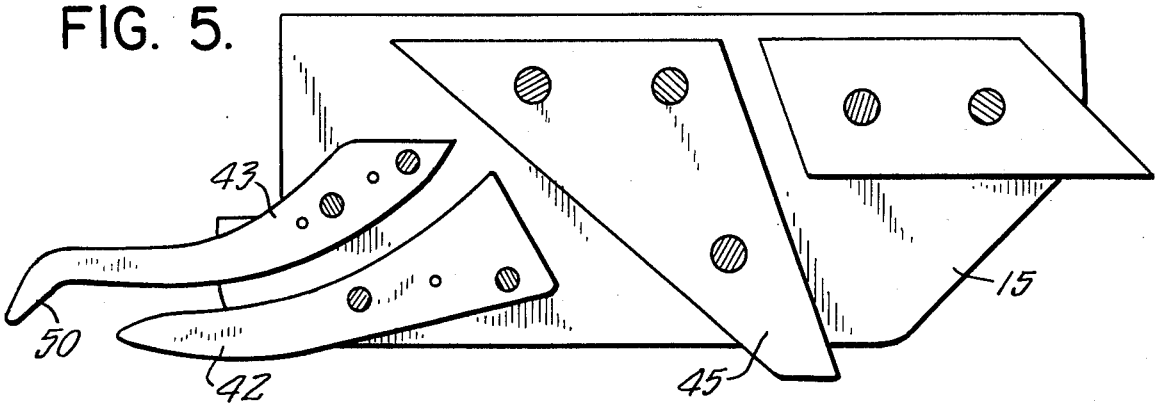
FIG. 5 is an enlarged, complete view of a modified jack cam section as seen from the interior, said view depicting the cam section shown in FIG. 4.

If the jack cam section 15 is used to further raise jacks 13 after being acted upon by rackets 16, cam section 15 is of the form illustrated in FIG. 5. Jack cam section 15 embodies two jack raising cams 42 and 43, the higher cam 43 being positioned ahead of the lower one 42 with respect to the normal direction of machine operation, and a jack return cam 46. An external sectional view taken on line 4—4 of FIG. 1 is shown in FIG. 4. Referring to it, the jack butts 45 of jacks 13 can proceed in one of three manners at every passing of the jack cam section 15. Depending on which of the racket heads was engaged if any, and ultimately depending on the perforations in the pattern strip, jack 13 will begin its knitting operation with its butt 45 in position 51, 52 or 53. The butt 45 begins its knitting operation in position 53 if lever 20 engaged racket head 18, in position 52 if lever 36 engaged racket head 19, and in position 51 if neither racket head was engaged. If the butt is in position 51, it will remain undisturbed during the knitting operation passing through path below surface 47. Conversely, if the butt is initiated in the knitting operation in position 52 or 53, it will be elevated by jack raising cam 42 or 43 respectively, directed through channel 48 or 49 respectively, and then lowered by jack return cam 46. Raising cam 43 is positioned ahead of cam 42, and likewise racket head 18 is positioned ahead of racket head 19, so that butts 45 intended for channel 48 will strike against the lower edge 50 of cam 43 if they should rise excessively due to their momentums. Thus, jack cam section 15 can direct jacks 13 and their corresponding needles 12 through three distinct paths depending on the intial heights of the jack butts 45 or the perforations in the pattern strip.

Figure 8:
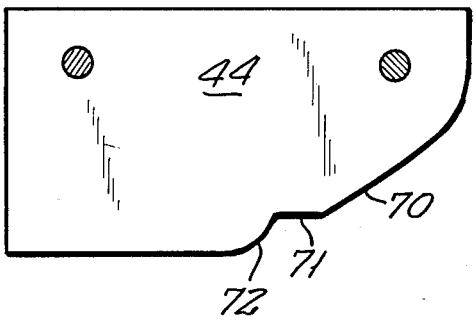
FIG. 8 is an enlarged, complete view of a modified selector cam as seen from the exterior.

If selector cam 44 is of the form illustrated in FIG. 8, the lower edge 50 of raising cam 43 completely covers the butts intended for channel 48 before they are even activated. The bottom engaging edge of selector cam 44 is partitioned into a first camming segment 70, a second dwell segment 71, and a third camming segment 72. Segment 70 rotates the higher tipped racket heads 18 thus lifting the jacks 13 and their butts 45 to a position where raising cam 43 can continue raising said butts and jacks. Segment 71, being horizontally positioned at a height where it cannot exert a force on the lower tipped racket heads 19, permits the lower edge 50 of raising cam 43 to advance and thus cover the jack butts intended for channel 48, before segment 72 rotates said racket heads thus raising said butts. Although not absolutely necessary, the horizontal segment 71 of selector cam 44 allows a certain amount of laxity in the precision of the dimensions of other machine parts.

Figure 6:
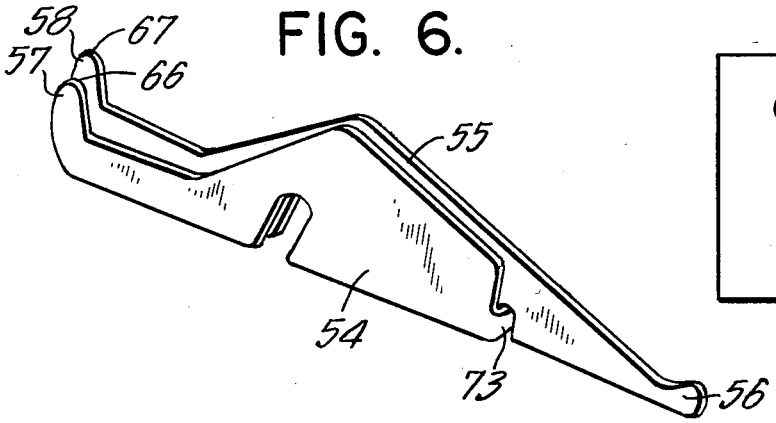
FIG. 6 is a perspective view of a second embodiment of the invention including pair of rackets modified to serve the function of the twin headed bi-level racket means.
Figure 7:
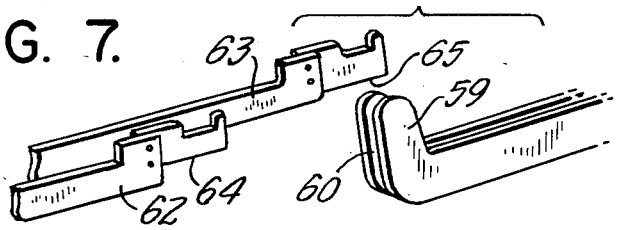
FIG. 7 is a perspective view of a pair of modified selection levers with a corresponding pair of racket heads.

FIGS. 6 and 7 show variant forms of the invention, the illustrated entities serving the same function as the twin headed bi-level racket. In FIG. 6, if racket head 57 is engaged, tail 73 of racket 54 engages and rotates the complementary tail 56 of racket 55, elevating complementary tail 56 to a lower height than if racket head 58 was engaged. This is caused by the difference in the vertical positions of tips 66 and 67 of racket heads 57 and 58 respectively, when tail 73 touches upon complementary tail 56.

FIG. 7 illustrates a modification to the previous two embodiments disclosed. The modification permits tips 68 and 69 of racket heads 18 and 19 of FIG. 3, and tips 66 and 67 of racket heads 57 and 58 of FIG. 6 to be positioned at the same height. In FIG. 7, if racket head 60 is engaged by selection lever 63 it rotates a greater extent and lifts the appropriate jack (not shown) a greater distance than if racket head 59 was engaged by selection lever 62. This is due to the difference in the vertical positions of the bottom engaging edges 64 and 65 of selection levers 62 and 63. The racket heads 59 and 60 may belong to a twin headed racket, similar to the type illustrated in FIG. 3, or to a pair of rackets, similar to the type illustrated in FIG. 6.

I wish it to be understood that I do not consider the invention to be limited to the precise details of structure shown and set forth in this specification, for obvious modifications will occur to those skilled in the art to which the invention pertains.

I claim:

1. In a knitting machine including a slotted drum having a plurality of slots on an arcuate surface thereof, a pattern strip passed about said drum and having perforations therein aligned with the slots in the drum, pivoted selection levers having means for reading the pattern and transmitting indications therefrom, pivoted racket means having means to engage said selection levers and rotate about a pivoted axis, said racket means having a selector cam engaging said selection levers, and needles having means for elevation initiated by said pivoted racket means, the improvement comprising: at least some of said needles being adapted for movement to two operational heights, each of said needles being selectively controlled by either of one of a pair of adjacent levers, said adjacent levers each having an end selectively engaging one of a pair of free end surfaces on a racket means, said last-mentioned surfaces being mutually spaced in a direction along an arcuate path of movement of said racket means, when said racket means is activated; whereby, depending upon which lever is acutated by the pattern strip during a given cycle of operation, the related free end surface on said racket means will elevate a related needle to either of two operative levels.

2. The improvement set forth in claim 1, further characterized in said racket means including two heads, the heads having lever-engaging surfaces constituting means to engage said selection levers which are mutually spaced in the plane of the racket means and are mutually laterally spaced relative to said plane.

3. The improvement set forth in claim 1, further characterized in the provision of a pair of adjacent rackets for each pair of adjacent levers, one of said pair of rackets having a free end actuating a respective needle, the other of said rackets being of shorter length and having a laterally-extending end, selectively engaging said one of said rackets.

4. The improvement set forth in claim 1, further comprising first and second needle elevating cams supported by said knitting machine, one of said first and second cams engaging needles for elevation to a first operative height upon actuation of one of said pair of adjacent levers; the other of said cams engaging said needles to elevation to a second operational height upon actuation of the other of said pair of levers.

5. The improvement set forth in claim 4, further characterized in one of said pair of cams serving to selectively raise a needle to the higher of said two operational heights, being positioned ahead of the other of said cams with respect to the normal direction of knitting machine operations; whereby needles intended for engagement with the other of said cams may strike a lower edge of said one of said cams to be downwardly deflected in the event that they rise excessively due to momentum.

6. The improvement set forth in claim 1 wherein said selector cam has a camming edge including a first camming segment, a second dwell segment, and a third camming segment whereby to slightly delay elevation of needles intended to be elevated to the lower of said two operative heights to permit less critical adjustment of the component parts of said knitting machine.

* * * * *